US010155230B2

(12) United States Patent
Stone

(10) Patent No.: US 10,155,230 B2
(45) Date of Patent: Dec. 18, 2018

(54) CENTRIFUGE FOR SEPARATING SOLIDS FROM SOLIDS LADEN DRILLING FLUID

(71) Applicant: National Oilwell Varco, L.P., Houston, TX (US)

(72) Inventor: Lyndon Ray Stone, Porter, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 324 days.

(21) Appl. No.: 14/290,554

(22) Filed: May 29, 2014

(65) Prior Publication Data

US 2014/0357464 A1 Dec. 4, 2014

(30) Foreign Application Priority Data

May 30, 2013 (GB) ..... 1309652.4

(51) Int. Cl.

| | |
|---|---|
| ***B04B 1/20*** | (2006.01) |
| ***B04B 11/02*** | (2006.01) |
| ***E21B 21/06*** | (2006.01) |
| ***E21B 43/34*** | (2006.01) |

(52) U.S. Cl.

CPC ..... *B04B 1/20* (2013.01); *B04B 11/02* (2013.01); *E21B 21/065* (2013.01); *E21B 43/34* (2013.01)

(58) Field of Classification Search

CPC ... B04B 1/20; B04B 11/02; B04B 2001/2083; E21B 43/34; E21B 21/065

USPC ..... 494/10, 37, 2, 3

See application file for complete search history.

(56) References Cited

U.S. PATENT DOCUMENTS

| | | | | |
|---|---|---|---|---|
| 3,045,750 | A * | 7/1962 | Peters | E21B 43/00 166/250.01 |
| 3,365,009 | A * | 1/1968 | Burnham | E21B 21/067 138/45 |
| 4,626,754 | A | 12/1986 | Habermann et al. | |
| 5,217,428 | A * | 6/1993 | Schlip | B04B 1/20 494/53 |
| 5,265,730 | A | 11/1993 | Norris et al. | |
| 5,948,271 | A * | 9/1999 | Wardwell | B04B 1/20 210/143 |

(Continued)

FOREIGN PATENT DOCUMENTS

| | | | | |
|---|---|---|---|---|
| EP | 2392910 | A2 * | 12/2011 | G01N 9/26 |
| GB | 1309652 | | 3/1973 | |

(Continued)

OTHER PUBLICATIONS

International Search Report for GB Patent Application No. GB1309652.4 dated Nov. 19, 2013, 3 pages.

*Primary Examiner* — Walter D. Griffin
*Assistant Examiner* — Shuyi S. Liu
(74) *Attorney, Agent, or Firm* — Conley Rose, P.C.

(57) ABSTRACT

A flow apparatus for a separation apparatus for separating solids from a solids laden drilling fluid includes a feed conduit for feeding solids laden drilling fluid to the separation apparatus, a liquid discharge conduit for conveying a liquid phase discharge from the separation apparatus, and a solids discharge port for allowing discharge of solids phase from the separation apparatus. Also included is a parameter measuring apparatus connected to the feed conduit and the liquid discharge conduit for measuring at least one parameter of at least one of the solids laden drilling fluid and the liquid phase discharge.

16 Claims, 7 Drawing Sheets

(56) References Cited

U.S. PATENT DOCUMENTS

| | | | | |
|---|---|---|---|---|
| 8,172,740 | B2 * | 5/2012 | El Dorry | B04B 1/2016 494/10 |
| 2010/0200242 | A1 * | 8/2010 | Rodger | E21B 43/34 166/369 |
| 2013/0037493 | A1 * | 2/2013 | Konigsson | B01D 21/262 210/787 |
| 2015/0011371 | A1 * | 1/2015 | Kimura | A61M 1/3693 494/6 |

FOREIGN PATENT DOCUMENTS

| | | | |
|---|---|---|---|
| WO | 96/33792 | 10/1996 | |
| WO | 98/16328 | 4/1998 | |
| WO | 98/37307 | 8/1998 | |
| WO | WO 2013145997 A1 * | 10/2013 | A61M 1/3693 |

* cited by examiner

CENTRIFUGE FOR SEPARATING SOLIDS FROM SOLIDS LADEN DRILLING FLUID

CROSS-REFERENCE TO RELATED APPLICATION

This application claims the benefit of GB Patent Application No. 1309652.4, filed on May 30, 2013, the entire contents of which are hereby incorporated by reference.

BACKGROUND

The invention relates to a centrifuge and a method for operating a centrifuge for separating solids from solids laden drilling mud.

In the drilling of a borehole in the construction of an oil or gas well, a drill bit is arranged on the end of a drill string, which is rotated to bore the borehole through a formation. A drilling fluid known as "drilling mud" is pumped through the drill string to the drill bit to lubricate the drill bit. The drilling mud is also used to carry the cuttings produced by the drill bit and other solids to the surface through an annulus formed between the drill string and the borehole. The density of the drilling mud is closely controlled to inhibit the borehole from collapse and to ensure that drilling is carried out optimally. The density of the drilling mud affects the rate of penetration of the drill bit. By adjusting the density of the drilling mud, the rate of penetration changes at the possible detriment of collapsing the borehole. The drilling mud may also carry commercial solids i.e. any purposely added solids, such as lost circulation materials for sealing porous sections of the borehole. The acidity of the drilling mud may also be adjusted according to the type of formation strata being drilled through. It is not uncommon to have 30 to 100 $m^3$ of drilling fluid in circulation in a borehole. The drilling mud contains inter alia expensive synthetic oil-based lubricants and it is normal therefore to recover and re-use the used drilling mud, but this requires inter alia the solids to be removed from the drilling mud. This is achieved by processing the drilling mud. The first part of the process is to separate large solids and lost circulation material from the solids laden drilling mud. This is at least partly achieved with one or more a vibratory separators, such as those shale shakers disclosed in U.S. Pat. No. 5,265,730, WO 96/33792 and WO 98/16328. The shale shakers may be cascaded in series of stages, such as three stages: a scalping deck having a large mesh screen suitable for removing colloidal material such as clumps of clay; a primary deck having fine mesh screen for removing large particles (but smaller than the colloidal material) which may include lost circulation material; and a secondary deck having a fine screen to remove small particles, mainly drill cuttings. The decks may be arranged in a single basket or in separate baskets and vibrated with a vibratory mechanism.

Further processing equipment such as a centrifuge may be used to further clean the drilling mud of smaller solids. The centrifuge may be used to remove large and medium size solids, although it is particularly suitable for removing small, heavy particles such as "barites" and thickening agents commonly referred to as "bentonites". These particles are generally too small for a screen in a shale shaker to remove. The resultant drilling mud is returned to the active mud system of the drilling rig.

A mud engineer will analyze the resultant drilling mud and inter alia: dilute the drilling mud if it is too viscous; add more bentonites if the drilling mud is not viscous enough; and add more barites if the drilling mud is not dense enough for recirculation.

It should also be note that a centrifuge may be used without or ahead of the shale shakers or directly after only one or two stage of screening. Furthermore, the centrifuge may be used to clean drilling mud or other fluids on a rig which are not being continuously circulated in the well.

Centrifuges are typically used in any one of three modes of operation:

1. low gravity solids (LGS) removal, in water based mud (WBM) while meeting environmental discharge criteria, and in oil based mud (OBM/NAF) while meeting environmental discharge criteria
2. barite separation, which sometimes requires two centrifuges; and
3. dewatering, simply discharging as many solids as possible.

Typically, Low Speed Decanting is used for Barite removal. Separating factor 500-700, 4-7 micro-meter particle size. Barite is a dense mineral comprising barium sulfate [BaSO4]. Commonly used as a weighting agent for all types of drilling fluids, barites are mined in many areas worldwide and shipped as ore to grinding plants in strategic locations, where API specifies grinding to a particle size of 3 to 74 microns. Pure barium sulfate has a specific gravity of 4.50 g/cm, but drilling-grade barite is expected to have a specific gravity of at least 4.20 g/$cm^3$ to meet API specifications. Contaminants in barite, such as cement, siderite, pyrrhotite, gypsum and anhydrite, can cause problems in certain mud systems and should be evaluated in any quality assurance program for drilling-mud additives.

Typically, Medium Speed Decanting is used with a separating factor 800 for 5-7 micrometer separation.

SUMMARY

High Speed Decanter Separating factor 1200-2100 rpm for 2-5 micrometer separation.

The present invention may be used in any of the three modes of operation or for any other form of separation stage.

The inventors have noted that use of the centrifuge is not optimized. The centrifuge is adjusted manually to achieve desired results, which produces inconsistent results. The inventors noted that the centrifuge may be operated to produce drilling mud which does not need to be adjusted or only minimally for re-circulation. The inventors also observed that the price of clean drilling mud, bentonite and barites and the cost of processing used drilling mud vary, making it economically desirable to use the centrifuge in different ways according to these costs. Thus optimum performance of the centrifuge may vary according to these costs.

In accordance with the present invention, there is provided a flow apparatus for a separation apparatus for separating solids from a solids laden drilling fluid, the flow system comprising a feed conduit for feeding solids laden drilling fluid to the separation apparatus, a liquid discharge conduit for conveying discharged liquid phase from said separation apparatus and a solids discharge port for allowing discharge of solids phase from said separation apparatus, characterized in that said flow system comprises a parameter measuring apparatus connected to said feed conduit and said liquid discharge conduit.

Preferably, the flow apparatus comprises at least one valve to selectively allow solids laden drilling fluid or discharged liquid phase through the parameter measuring apparatus and advantageously, a plurality of valves, which may be controlled from a control system, such as a computer and be actuated using an electric, hydraulic or pneumatic means, such as an electric stepper motor.

Advantageously, the at least one valve is a two-way valve and preferably a plurality of two-way valves, such as six. Alternatively, or additionally, the at least one valve comprises a three-way valve, preferably a plurality such as three three-way valves.

Preferably, the flow apparatus comprises a feed tank. The feed tank receives solids laden drilling mud directly from the well or preferably from other solids control apparatus such as a shale shaker, degasser, hydrocyclone, mud cleaner or a further centrifuge. Preferably, the feed tank forms part of a tank system, wherein separate tanks are arranged between each of or some of the other solids control equipment.

Preferably, the parameter measuring apparatus comprises a coriolis meter for measuring mass flow or other apparatus for measuring mass flow. Advantageously, the parameter measuring apparatus may also or alternatively comprise: a temperature sensor for measuring temperature; spaced apart pressure sensors for use in measuring a pressure differential and calculating density therefrom or other density measuring apparatus; a velocity sensor; and viscosity sensor.

Preferably, a control system is provided for receiving data from said parameter measuring apparatus and advantageously controlling its operation.

Advantageously, the separation apparatus is a centrifuge. The centrifuge preferably having a bowl for retaining a pond of solids laden drilling mud and a conveyor, an inlet for solids laden drilling mud to be introduced to the bowl, a solids discharge outlet and a drilling mud discharge outlet, a bowl drive for driving the bowl and a conveyor drive for driving the conveyor.

The present invention also provides a method of flowing fluid to a separation apparatus, the method comprising the steps of flowing a solids laden drilling fluid through a feed conduit into a separation apparatus, conveying discharged liquid phase from said separation apparatus through a liquid discharge conduit and discharging a solids phase from said separation apparatus through a solids discharge port, characterized in that a parameter measuring apparatus is connected to said feed conduit and said liquid discharge conduit, such that the parameter measuring apparatus selectively takes a parameter reading of the solids laden drilling fluid and the liquid discharge phase.

Preferably, parameter reading of the solids laden drilling fluid and the liquid discharge phase are logged. Advantageously, the parameter reading of the solids laden drilling fluid is logged once every two to sixty minutes, preferably every five to thirty minutes and advantageously every ten to twenty minutes.

Preferably, the parameter reading of the liquid discharge phase is logged once every ten to sixty minutes, preferably every five to thirty minutes and advantageously every ten to twenty minutes.

Advantageously the method further comprises the step of activating at least one valve to select flow of solids laden drilling fluid or the liquid discharge phase through the parameter measuring apparatus.

Thus, the invention describes techniques for using automated two way control valves or three way directional control valves and piping arrangements to facilitate the use of a single mass flow meter to measure the mass flow of the process slurry sent to a centrifuge and the mass flow of the liquid discharge from the centrifuge. The two measurements cannot be taken simultaneously. The valves can be connected to actuators which can be operated by either hydraulic, pneumatic or electric means. The actuators are connected to a control system that positions the valves to direct either the process slurry or the liquid discharge from the centrifuge through the mass flow meter. The valves can have an output signal which will tell the control system the current position of the valve.

BRIEF DESCRIPTION OF THE DRAWINGS

For a better understanding of the present invention, reference will now be made, by way of example, to the accompanying drawings, in which.

DETAILED DESCRIPTION

Figure 1:
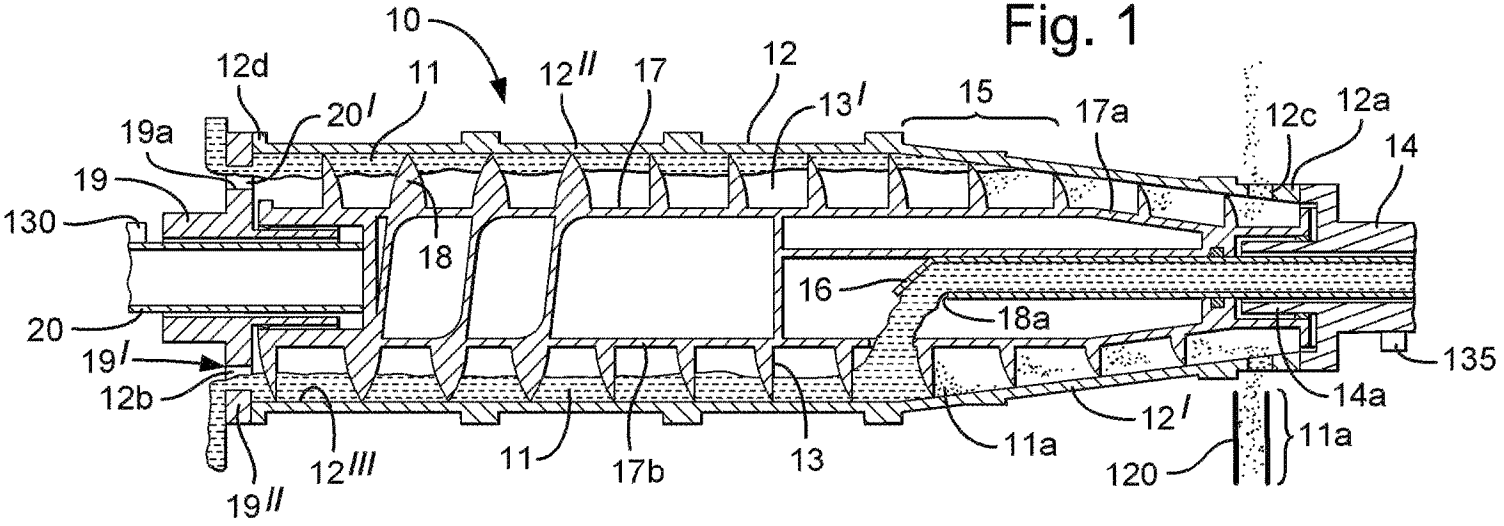
FIG. 1 is a sectional view of a part of the centrifuge shown in FIG. 2.

FIG. 1 shows a centrifuge generally identified by the reference numeral 10. The centrifuge 10 has a bowl 12, supported for rotation about its longitudinal axis. The bowl 12 is in the form of a hollow solid walled cylinder of circular cross-section preferably having a first bowl portion 12' having an internal diameter which reduces in a tapering fashion towards a distal end 12*a* and a second bowl portion 12" having a substantially constant internal diameter from the first bowl portion 12' to a proximal end 12*d*. The bowl 12 has an opening at each of the distal and proximal ends 12*a* and 12*d*, the distal end 12*a* having a drive flange 14 fitted into the opening which is connected to a drive shaft 21 for rotating the bowl 12. The drive flange 14 has a longitudinal passage which receives a feed tube 16 for introducing a feed slurry, such as solids laden drilling mud, into the interior of the bowl 12.

Figure 4:
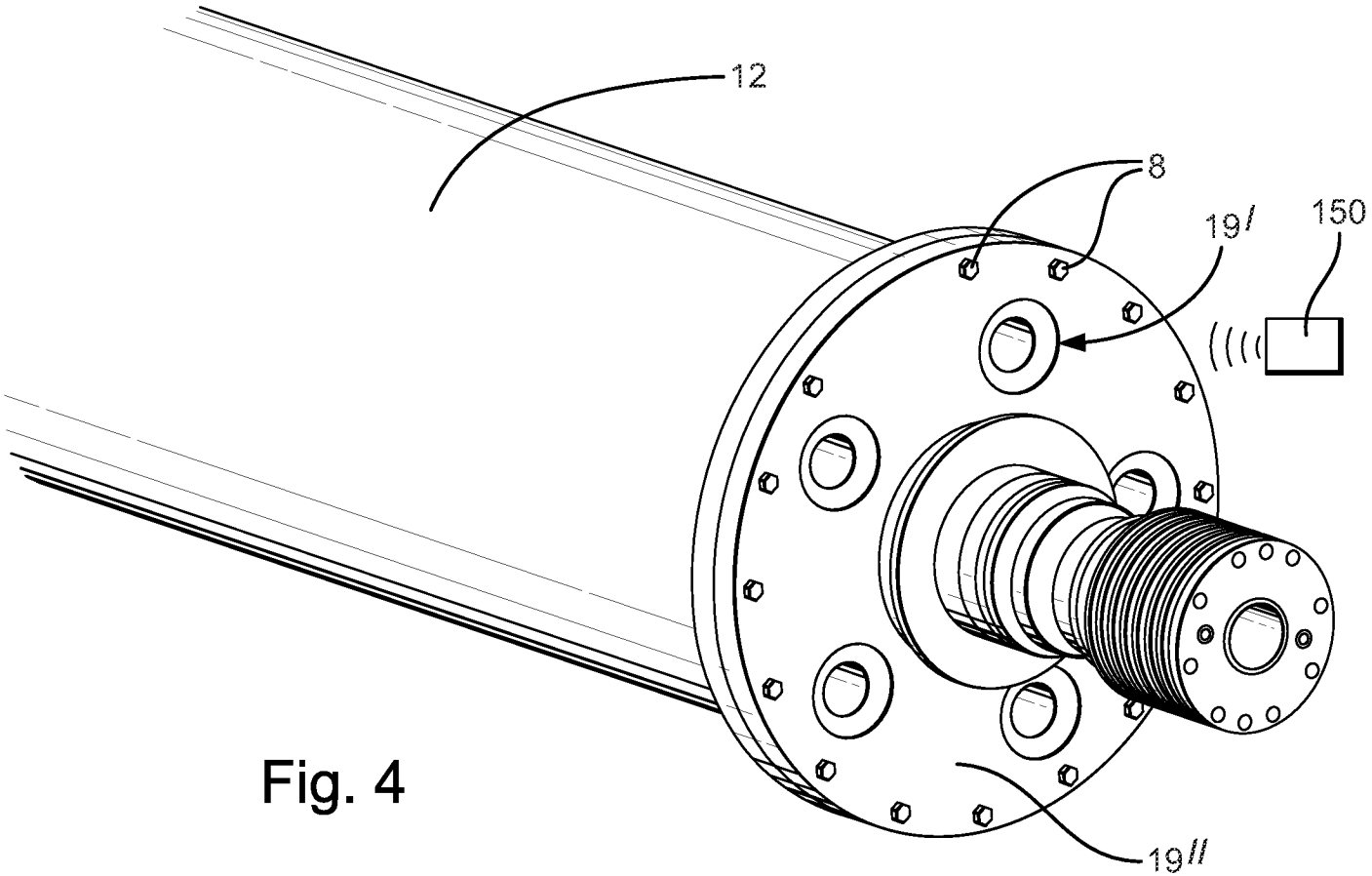
FIG. 4 is a perspective view of a part of the centrifuge shown in FIG. 1.

A hollow flanged shaft 19 is disposed in the opening in the proximal end 12*d* of the bowl 12 and preferably fixed thereto with a plurality of bolts 8 (shown in FIG. 4). The hollow flanged shaft 19 receives a drive shaft 20 of an external planetary gear box 32 for rotating a screw conveyor 18 in the same direction as the bowl 12 at a selected speed, which may be at a different speed from the bowl 12.

The screw conveyor 18 is arranged within the bowl 12 in a coaxial relationship thereto and is supported for rotation within the bowl 12 between a distal hollow stub axel 14*a* of the drive flange 14 and a distal hollow stub extending from flanged shaft 20. The screw conveyor 18 has a hollow solid walled cylindrical body 17 of circular cross-section, a first part 17*a* of which has a tapering external diameter and a second part 17*b* which has a constant diameter. The screw conveyor 18 has a flight 13 of substantially constant pitch, although as an alternative may be a variable pitch (not shown). As an alternative, a further flight may be provided for a double-start flight (not shown). Annular depth of the flight 13 is preferably substantially constant along second part 17*b* of the screw cylindrical body 17, advantageously reducing in a tapering fashion in a linear taper or alternatively, non-linear taper (not shown), towards and along first part 17*a*. Openings (not shown) are formed in the cylindrical body 17 of the screw conveyor 18 in the region identified by reference numeral 15.

The solids laden drilling fluid flows from an inlet 18*a* of the feed tube 16 so that the centrifugal forces generated by the rotating bowl 12 move the slurry radially outwardly through the openings in region 15 in the solid walled cylindrical body 17 and into an annular space 13' between the solid walled cylindrical body 17 and the bowl 12. The liquid portion of the slurry forms a pond 11 and is displaced to the proximal end 12*d* of the bowl 12. Entrained solid particles 11*a* in the slurry settle towards the inner surface 12''' of the bowl 12 due to the G forces generated, and are scraped and displaced by the screw conveyor 18 back towards the distal end 12*a* of the bowl 12 for discharge through a solids discharge outlet(s) which may be a plurality of solids discharge ports 12*c* formed through the wall of the bowl 12 near its end 12*a*. The solids discharge ports 12*c* are arranged closer to the centerline of the bowl than the pond depth, thus only the solids are displaced through the discharge ports 12*c* with very little or no drilling mud. A cowling 10*a* (shown in FIG. 2) is provided about the bowl 12 to collect and direct the solids to a discharge pipe 120 into a discharge system, such as a skip, trough or solids conveying apparatus.

A liquid discharge outlet is provided in the bowl 12, which liquid discharge outlet may comprise liquid discharge ports 19' provided in flange 19'' of hollow flanged shaft 19. The flange 19'' is bolted to the bowl 12 with bolts 8 (shown in FIG. 4). The liquid discharge ports 19', preferably five ports, but may be any suitable number such as one to twenty, are spaced in a concentric circle about the flange 19'', each spaced from the inner surface 12''' of the bowl 12 at an equal distance. Thus the liquid discharge ports 19' act as weirs, controlling the depth of the pond 11.

Figure 5:
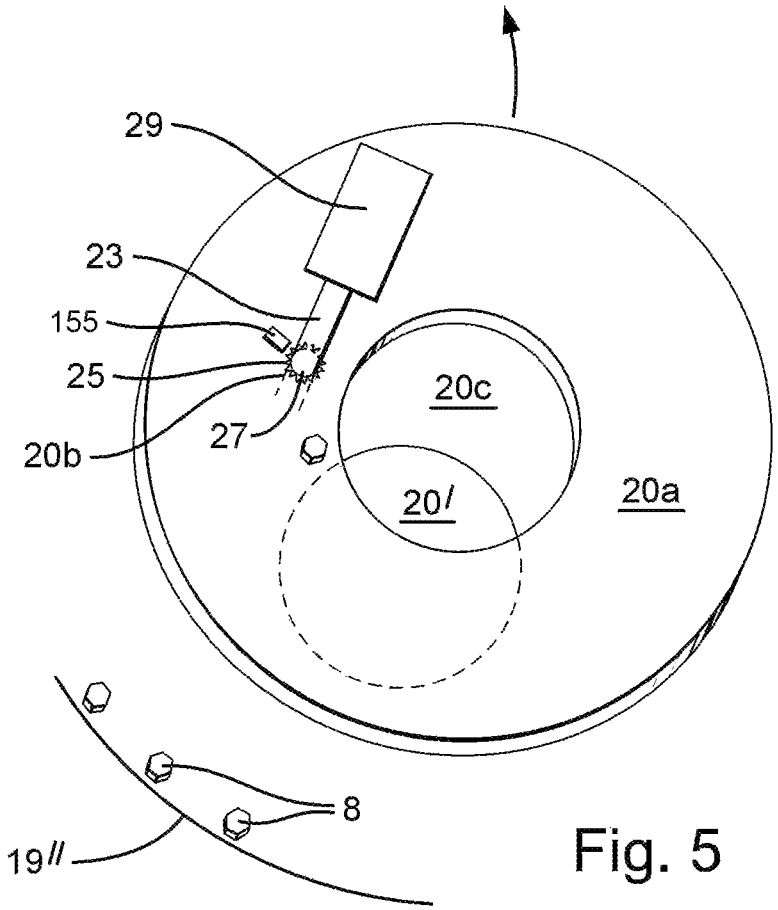
FIG. 5 is a schematic view of part of an automatic weir of the centrifuge shown in FIG. 1.

The liquid discharge ports 19' are shown in more detail in FIG. 4 and an alternative embodiment in FIG. 5. The liquid discharge ports 19' each comprise a circular hole 20' in the flange 19'', although the hole 20' may be of any shape, such as a polygon, oval and may take the form of a slot. The hole 20' is approximately five to ten centimeters in diameter. A disc gate 20*a* is pinned to the flange 19'' with a pin 20*b*. The pin 20*b* is rigidly fixed to the flange and may be welded thereto. The pin 20*b* may be placed at or close to a point on the same radius as the center of the hole 20', the radius taken from the center of the flanged shaft 19. The disc gate 20*a* is movable about the pin 20*b*. A toothed cog 27 engages with a splined opening 25 in the disc gate 20*a* about the pin 20*b*. A drive shaft 23 of a control motor 29 is rotationally fixed to the toothed cog 27. The disc gate 20*a* has a circular opening 20*c* therein, although the opening 20*c* may be of any shape such as a polygon or oval and may take the form of a slot. Upon activation of the control motor 29, the drive shaft 23 rotates rotating the disc gate 20*a* about the fixed pin 20*b*. The disc gate 20*a* is movable about the fixed pin 20*b* to vary the effective weir height. The control motor 29 moves disc gate 20*a* in small increments or linearly in response to commands from a control system PM.

The disc gate 20*a* may alternatively be solid, the outer perimeter of the disc gate 20*a* is used for the weir and thus controlling pond depth.

Figure 6:
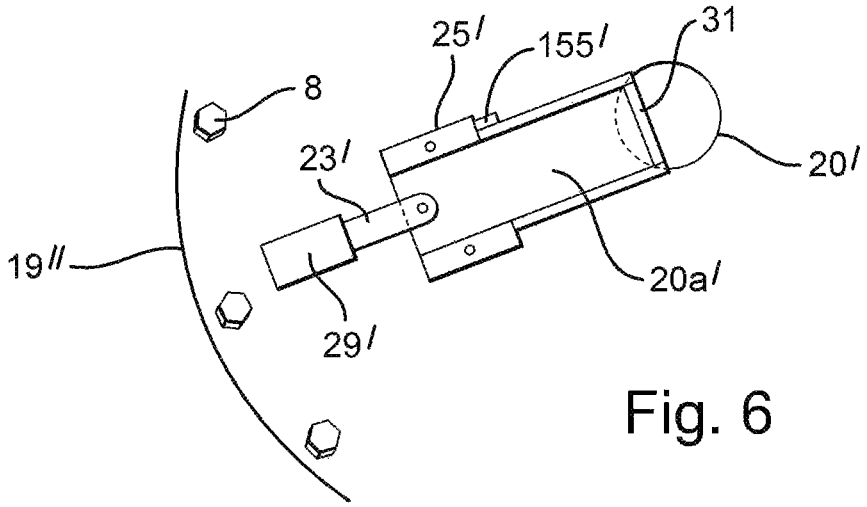
FIG. 6 is a schematic view of part of an alternative automatic weir to the automatic weir shown in FIG. 5.

Another alternative automatic weir is shown in FIG. 6. The disc gate 20*a* takes the form of a radially slideable gate 20*a*' arranged in a track 25'. The gate 20*a*' is slideable over the hole 20' with a linear actuator motor 29'. Activation of the linear motor 29' thus controls the position of the gate 20*a*' over the hole 20' by extending and retracting an arm 23' fixed to the gate 20*a*'. An end 31 of the gate 20*a*' acts as the weir and its position and thus weir height are controlled by the linear actuator motor 29'. The linear actuator motor 29' is controlled by control system PM.

Figure 2:
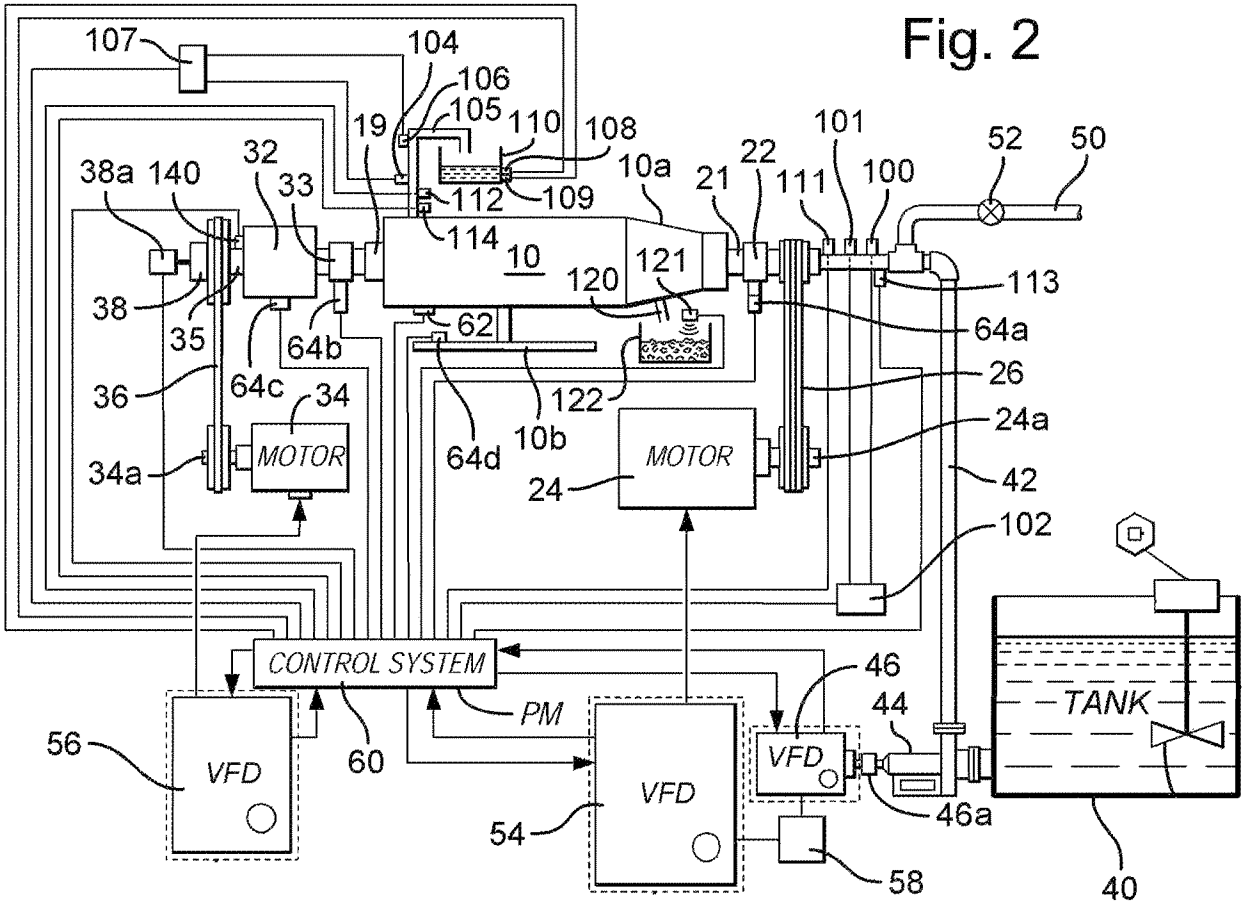
FIG. 2 is a schematic view of a drilling mud system including a centrifuge.

The centrifuge as shown in FIGS. 1 and 2 is enclosed in a cowling 10*a* in a conventional manner to collect and divert the flow of separated liquid into a fluid discharge pipe 105 and to collect and divert the solids into a solids discharge pipe 120.

As shown in FIG. 2, a drive shaft 21 forms an extension of, or is connected to, the drive flange 14 and is supported by a bearing 22. A variable speed AC main bowl drive motor 24 has an output shaft 24*a* which is connected to the drive shaft 21 by a drive belt 26 and therefore rotates the bowl 12 of the centrifuge at a predetermined operational speed. The flanged shaft 19 extends from the interior of the conveyor 18 to a planetary gear box 32 and is supported by a bearing 33. A variable speed AC back conveyor drive motor 34 has an output shaft 34*a* which is connected to a sun wheel 35 by a drive belt 36 and the sun wheel is connected to the input of the gear box 32. The conveyor drive motor 34 rotates the screw conveyor 18 of the centrifuge through the planetary gear box 32 which functions to establish a differential speed of the conveyor 18 with respect to the bowl 12. A coupling 38 is provided on the shaft of the sun wheel 35, and a limit switch 38*a* is connected to the coupling which functions in a conventional manner to shut off the centrifuge when excessive torque is applied to the gearbox 32.

For receiving and containing the feed slurry being processed, there is a tank 40 and a conduit 42 connected to an outlet opening formed in the lower portion of the tank to the feed tube 16. An internal passage through the shaft 21 receives the conduit 42 and enables the feed slurry to pass through the conduit and the feed tube 16 and into the conveyor 18.

The tank 40 may form part of a mud tank system (not shown) and comprises a series of tanks. A first tank is fed with underflow of screened solids laden drilling mud from a shale shaker. The first tank comprises a sand trap, such that sand settles therein on a pan. The sand is tapped off after sufficient build up. The screened solids laden drilling mud is then pumped from the first tank through a degasser to remove at least a portion of any gas which may be present in the screened solids laden drilling mud and flows into a second tank. The screened and degassed solids laden drilling mud is pumped from the second tank through a hydrocyclone to further remove sand particles. The screened, degassed and hydrocycloned solids laden drilling mud flows into a tank, such as tank 40 for further processing with the centrifuge 10. The first tank may be in the order of 20 to 200 barrels (3200 to 32,000 liters). The second tank may be in the order of 20 to 200 barrels (3200 to 32,000 liters). The tank 40 may be in the order of 20 to 200 barrels (3200 to 32,000 liters). The second tank may comprise an impeller to agitate to inhibit solids from settling. The inventors observed that the impellers in the second tank and the tank 40 tend to mix incoming flow with the solids laden drilling mud already in the respective second tank and tank 40.

The slurry is pumped from the tank 40 by a powered pump 44 which is connected to the conduit 42 and is preferably driven by a motor and most preferably having driven by a variable frequency drive unit 46, which pumps the slurry through the conduit 42 and the feed tube 16, and into the centrifuge 10. Optionally, a control valve 52 disposed in the conduit 50 controls flow through the conduit. Two variable frequency ("VFD") drives 54 and 56 are respectively connected to the motors 24 and 34 for driving the motors at variable frequencies and at variable voltages. The drive unit 46 may also be a variable frequency drive. Preferably, the VFDs 46, 54 and 56 are connected to and controlled by the control system PM.

Optionally, the VFD 54 is also electrically connected to the input of a magnetic starter 58, the output of which is connected to the drive unit 46. The VFD 54 supplies a control signal to the starter 58 for starting and stopping the drive unit 46, and therefore the feed pump 44.

The control system PM may be a computer provided which contains computer programs stored on a computer readable media, such as a ROM, RAM, in the computer itself containing instructions for controlling the operation of the drilling mud system: the centrifuge 10 and preferably the feed pump 44. To this end, the control system PM has several input terminals two of which are respectively connected to the VFDs 54 and 56 for receiving data from the VFDs, and two output terminals for respectively sending control signals to the VFDs. The control system PM thus responds to the input signals received and controls the VFDs 54 and 56 in a manner so that the drive units can continuously control the system and vary the frequency and the voltage applied to the respective AC motors 24 and 34, to continuously vary the rotation and the torque applied to the drive shaft 21 and to the sun wheel 35, respectively.

Figure 3:
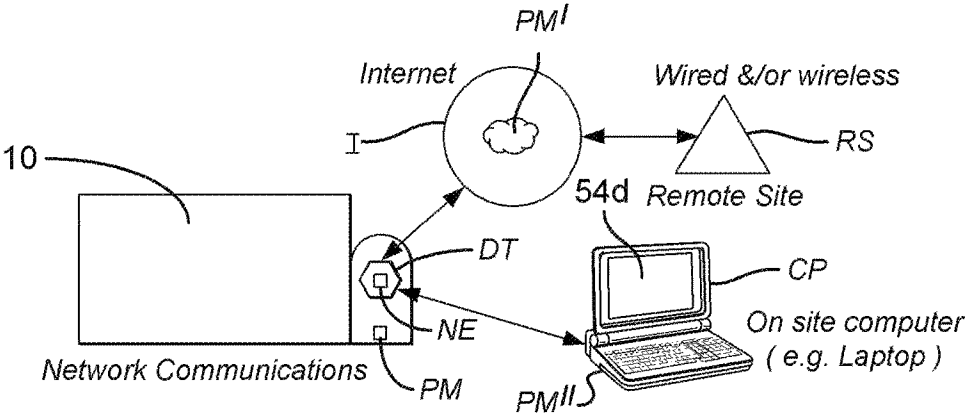
FIG. 3 is a schematic diagram showing options for location of a control system for the centrifuge.

The control system may be a Programmable Logic Controller having readable media containing instructions for controlling the operation. Alternatively, the control system may be a single board computer. Alternatively, the control system PM may comprise a dumb terminal DT having access, wired or wireless to an intranet I via a network connection NE or internet on which the instructions for controlling the operation are stored and/or executed. The sensors of the type set out herein may transmit their data through a wire back to bus connection of the dumb terminal DT from which the data is collected and passed through a network connection or wirelessly to the internet. Thus, the instructions for controlling the operation may be in a cloud PM'. An HMI apparatus (human-machine interface, e.g. the touch screen system) 54*d* provides a visual display of the system operation and a tactile means of control 54*d* for the control system. The HMI apparatus 54*d* is shown in FIG. 3 as part of or attached to a laptop computer CP, but may be arranged as part of dumb terminal DT on a skid 10*b* of the centrifuge and/or in a control room of a drilling rig and/or a remote control room RS distant from said drilling rig. The instructions for controlling the operation may alternatively be in a computer readable media PM" in the laptop CP. The centrifuge 10 could also be remotely monitored. This could be done by apps on a portable device such as a smart phone with different user profiles for technicians, customers, etc.

The control system PM has another input terminal connected to the drive unit 46 with a motor 46*a* for receiving data from the drive unit 46. Another output terminal of the control system PM is connected to the drive unit 46 for sending control signals to the drive unit 46. The control system PM thus responds to the input signals received from at least one the VFDs 54 and 56 and can send corresponding signals to the drive unit 46 for varying the operation of the feed pump 44. Another input terminal of the control system PM is connected to the limit switch 38*a* which provides a signal in response to excessive torque being applied to the gear box 32.

Mounted on the outer surface of the bowl 12 is a vibration sensor 62, such as an accelerometer which is connected to the control system PM, and responds to excessive vibrations of the centrifuge for generating an output signal that causes the control system to send signals to the VFDs 54 and 56 to turn off the motors 24 and 34, respectively, and therefore shut down or slow down the centrifuge.

Near the bearings 22 and 33 are connected a pair of accelerometer sets 64*a*, 64*b*, 64*c* and 64*d* each set advantageously including two accelerometers for respectively measuring certain operational characteristics, particularly, but not exclusively, at high frequencies of the drive shafts and 20 and their associated bearings, gearbox 32 and equipment skid 10*b* on which the centrifuge 10 sits. The accelerometer sets 64*a*, 64*b*, 64*c* and 64*d* are connected to the control system PM for passing their respective output signals to the control system PM for processing. The accelerometer sets 64*a*, 64*b*, 64*c* and 64*d* can be of the type disclosed in U.S. Pat. No. 4,626,754, the disclosure of which is hereby incorporated by reference.

Each accelerometer set preferably includes two or more accelerometers having orthogonal axes that are placed on the frames of the bearings 22 and 33 for detecting vibrations caused by the rotating bowl 12 and screw conveyor 18, as well as the drive shaft 21 and the sun wheel 35. The accelerometer signals provided by the accelerometers of each set 64*a*, 64*b*, 64*c* and 64*d* are passed to the control system PM where a computer program contained therein analyzes the signals for the presence of specific predetermined frequency signatures corresponding to particular components and their status, which could include a potentially malfunctioning condition. The computer program is designed to provide instructions to produce an output in response to any of these frequency signatures being detected. The accelerometer signals are analyzed by the control system PM and upon using the evolutionary operation parameter change method as set out below, if the accelerometer signals pass a predetermined threshold, are regarded as constraints on the system and the control system may regard any change in the parameter as a performance not improved status. The back current to the drive units 24 and 34, are proportional to the loading of the bowl 12 and the conveyor, respectively, the values of which is fed back to the control system PM.

The control system PM has conventional devices including, but not limited to, programmable media, computer(s), processor(s), memory, mass storage device(s), video display (s), input device(s), audible signal(s), and/or programmable logic controller(s), access to storage on the internet and cloud, such that any computer program used by the control system PM may be stored and/or run on in the cloud. Optionally, e.g. in field applications, a generator is provided which generates electrical power and passes it to a breaker box which distributes the power to the VFDs 54, 56, and 46. Optionally, the VFD 54 (and any VFD of the system 10 and any VFD disclosed herein) can have a manual potentiometer apparatus for manually controlling a motor; a display or window in a display for displaying inter alia torque; a display or window in a display 54*c* for displaying rpm/speed display apparatus; and/or an HMI apparatus (human-machine interface, e.g. the touch screen system) 54*d* which provides a visual display of the system operation and a tactile means of control.

In use, the storage tank 40 receives the slurry, (which, in one particular aspect, is a mixture of drilling fluid and drilled cuttings). The control system 60 sends an appropriate signal, via the VFD 54, to the starter 58 which functions to start the VFD 46 and activate the pump 44. The slurry is pumped through the conduit 42 and into the interior of the bowl 12 under the control of the control system 60. The bowl drive motor 24 is activated and controlled by the VFD 54 to rotate the drive shaft 21, and therefore the bowl 12, at a predetermined speed. The conveyor drive motor 34 is also activated and driven by the VFD 56 to rotate the sun wheel 35, and therefore the screw conveyor 18, through the planetary gear box 32, in the same direction as the bowl 12 and at a different speed. As a result of the rotation of the bowl 12, the centrifugal force thus produced forces the slurry radially outwardly so that it passes through the inlet 18*a* in the conveyor and into the annular space between the conveyor and the bowl 12. The drilling fluid portion of the slurry is displaced to the end 12*b* of the bowl 12 for discharge from the weirs 19*a* in the flanged shaft 19. The entrained solid particles (drilled cuttings) in the slurry settle towards the inner surface of the bowl 12 due to the G forces generated, and are scraped and displaced by the screw conveyor 18 back towards the end 12*a* of the bowl for discharge through the discharge ports 12*c*.

The control system PM receives signals from the VFD 46 or flow meter 113 corresponding to the pumping rate of the feed pump 44, and signals from the VFDs 54 and 56 corresponding to torque and speed of the motors 24 and 34, respectively. The control system PM contains instructions which enable it to process the above data and control the VFDs. The control system PM controls the VFDs 54 and 56 to vary the frequency and voltage applied to the motors 24 and 34, as needed to control and/or continuously vary the rotational speed of, and the torque applied to, the drive shaft 21 and the sun wheel 35, to maintain predetermined optimum operating conditions. The control system PM also monitors the torque applied to the sun wheel 35 from data received from the VFD 56 and maintains the torque at a desired level. In the event one of the inputs to the control system PM changes, the system contains instructions to enable it to change one or more of its output signals to the VFDs 54 and 56 and/or the VFD 46, to change their operation accordingly. The accelerometer sets 64*a*, 64*b*, 64*c* and 64*d* respond to changes in rotational speed of the drive shaft 21 and the sun wheel 35, and therefore the bowl 12 and the conveyor 18, in terms of frequency, as well as changes in the drive current to the motors 24 and 34 in terms of amplitude which corresponds to load. In the event the centrifuge becomes jammed for whatever reason the control system PM will receive corresponding input signals from the VFDs 54 and/or 56 and will send a signal to the starter 58 to turn off the feed pump 44 and thus cease the flow of the feed slurry to the centrifuge.

The control system PM of the invention attempts to optimize performance of the centrifuge. The optimization requires an "optimal" operation. The definition of "optimal" operation is programmed into the control system and is preferably either of the following algorithms:

1. Maximize the economic benefit of the centrifuge by maximizing the equation: E=D−B−F−b, where E=the net economic benefit ($) from operating the centrifuge D=the cost of the base fluid that would otherwise have to be used to dilute the used drilling mud if the centrifuge wasn't operating to remove the fine drilled solids. The % drilled solids in the mud should be kept below a certain threshold or problems such as slow drilling and stuck pipe can occur.

B=cost of the barite that is lost via the centrifuge solids discharge

F=cost of the base fluid that is lost via the centrifuge solids discharge b=cost of the bentonite gel (thickening agent) that is lost via the centrifuge solids discharge 2. Minimize the operational cost of the mud system based on the sum of the following costs a. mud dilution (new mud that has to be added to the working volume to reduce the percentage of solids in the mud)

b. chemical additives that must be replaced because the centrifuge discarded some of them (barite, chlorides, well bore stability materials, lost circulation material (LCM), etc.)

3. ignore the loss of chemical additives and just minimize the mud dilution costs by maximizing the LGS removal rate while still meeting environmental discharge requirements 4. achieve either of the two above objectives while minimizing maintenance costs The parameters in a centrifuge in accordance with the present invention comprise:

1. bowl speed (directly affects acceleration or g-force)
2. conveyor speed (differential–relative difference in speed between the bowl and conveyor)
3. slurry feed rate
4. pond depth Bowl speed is varied by the control system PM by signaling the VFD 54 controlling the bowl drive motor 24.

Conveyor speed is varied by the control system PM by signaling the VFD 56 controlling the conveyor drive motor 34.

Slurry feed rate is varied by the control system PM by signaling the VFD 46 controlling the slurry feed pump 44.

Pond depth is varied by the control system PM by signaling the control motor 29 or linear motor 29'.

Figure 7:
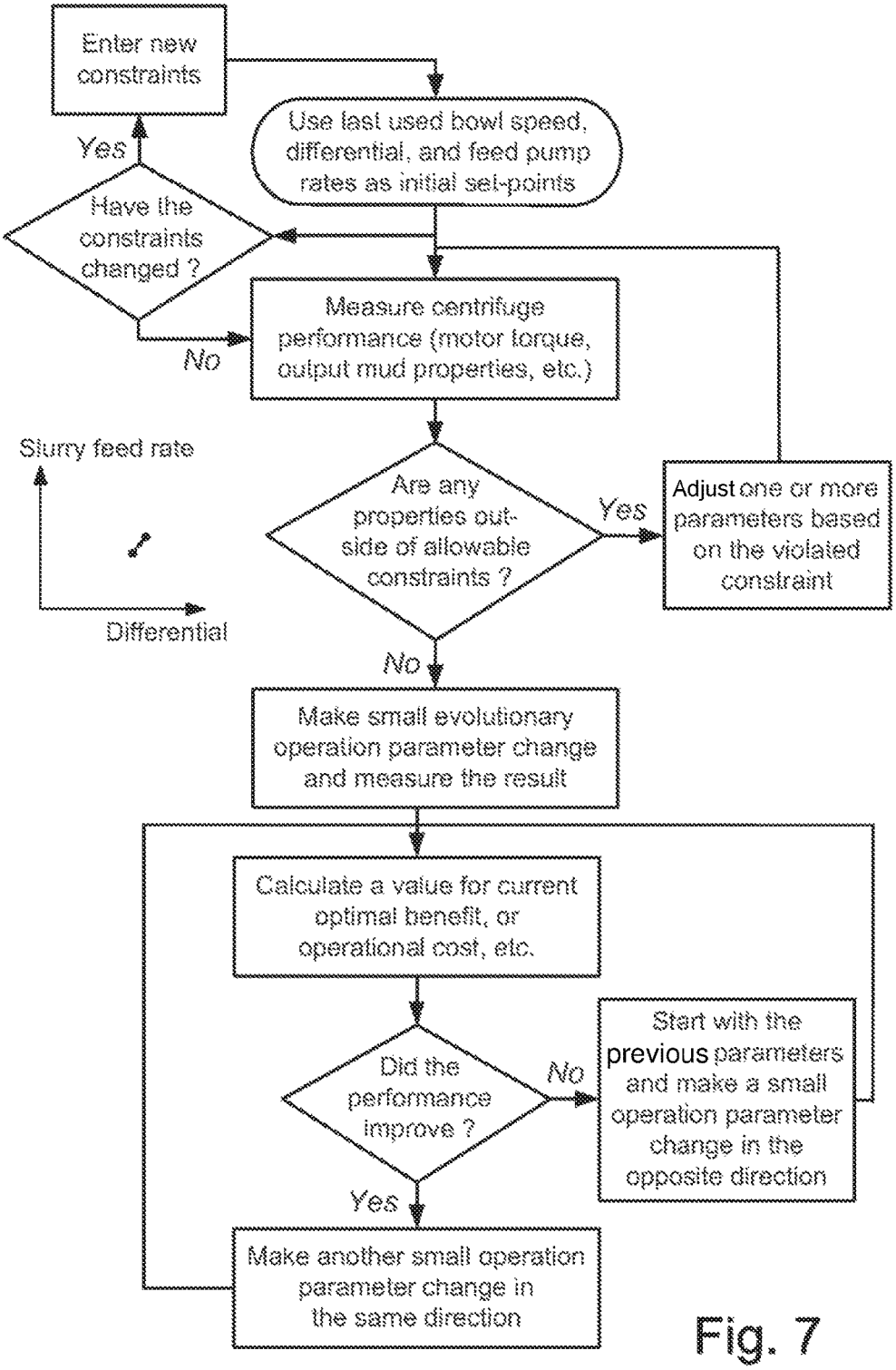
FIG. 7 is a flow diagram setting out steps in a method in accordance with the present invention.

The parameters are adjusted to achieve the optimum as established by one of the two above equations using an "evolutionary operation" approach. A flow diagram showing steps in the operation in accordance with the present invention is shown in FIG. 7. This entails using a set of operating parameters as a starting point, for example, the rotational speed of bowl 12, the rotational speed of conveyor 18 and speed of feed pump 44 are initially set at the speeds used in the centrifuge's last use. The control system PM calculates the value of an optimization algorithm, such as the algorithm above. The control system PM measures the performance using at least one sensor. If the performance is not optimal, as defined by the algorithm, then the control system will select a parameter to change, for example, one of the rotational speed of bowl 12, the rotational speed of conveyor 18 and speed of feed pump 44. The control system checks that making a small change to the selected operational parameter is within constraints. For example, if the bearings 33 are not able to cope with the small increase in speed of the conveyor 18, then the control system would not increase the speed of the conveyor 18 and move on to making a small change in another parameter, such as the bowl speed 12, which again would be checked to be within constraints. The small change to the parameter would then be made by the control system PM. The control system then monitors the performance for improvement toward optimum performance. If the performance improves, then this new set of operating parameters would become the new starting point. If not, then the parameter that was changed would be changed by a small amount in a different, preferably opposite direction and the performance measured again. By automatically repeating this process over and over with every parameter, the centrifuge is made to continually seek out optimal performance. Preferably, each change is made every fifteen minutes, although it is envisaged that a change made every two minutes, five minutes, twenty minutes or thirty minutes or any other reasonable time interval is feasible, preferably allowing at least a portion of the feed slurry separation to be separated by the centrifuge 10 under the new changed parameter before the process is repeated. The time interval is preferably programmed into control system PM so that the process is repeated automatically.

When the control system PM checks that making a small change to the selected operational parameter is within constraints and if the parameter would not be within constraints, then another parameter is picked by the control system. This is preferably defined by a predetermined list programmed into the control system PM of parameters and the control system moves on to the next parameter in the predetermined list.

The parameters are constrained by the following constraints:

1. Maximum allowable % moisture on cuttings (as determined by regional regulations or customer preference). If the % moisture on cuttings discharged from the centrifuge is too high, then the centrifuge control system PM adjusts any or all of the following parameters:

a. reduce the feed pump 44 speed in order to reduce the solids load in the bowl 12;

b. reduce the differential speed between the conveyor 18 and bowl 12 preferably, by reducing the conveyor drive motor 34 speed in order to increase the retention time of the solids in the bowl 12;

c. reduce the pond depth of the feed slurry 11 in the bowl 12 by activating gate position motor 29, 29' to retract the gate 20 *a*,20 *a'* to allow more fluid to be returned to the active mud system;

2. Maximum allowable torque on conveyor drive motor 34 or bowl drive motor 24. If the torque is too high, then the centrifuge control system PM adjusts any or all of the following parameters:

a. reduce the feed pump 44 speed in order to reduce the solids load in the bowl 12;

b. increase the differential speed between the conveyor 18 and bowl 12 by increasing the conveyor drive motor 24 speed to push the solids out faster and therefore have a shallower solids bed dragging against the conveyor 18;

3. Maximum allowable barite loss rate (determined by the customer's barite loss tolerance). If the barite loss rate is too high, then the centrifuge computer would adjust any or all of the following parameters:

a. reduce the feed pump 44 speed in order to reduce the amount of barite processed by the centrifuge.

The following data may be obtained for use in the control system PM. At least one, preferably several and most preferably all of the following will be required and measured values sent to the control system. The data includes feed slurry data, flow rate data, retrieved solids data, retrieved fluid data and centrifuge apparatus data. Preferably, the data is retrieved in real time, taken every few minutes, although certain of the data may take a relatively long time to obtain, taken every few hours.

1. Liquid density measured preferably at at least one of the following:

a. of the feed slurry at the input to centrifuge 10, preferably using differential pressure measurement along a part of the feed pipe. First and second pressure sensors 100,101 are located along the feed pipe 42, spaced a few meters apart. The differential pressure readings taken from the pressure sensors 100, 101 sent back to a measurement system 102, such as a computer, which may be a part of the control system PM or separate. The measurement system 102 calculates the pressure differential and density of the slurry can thus be derived. Other factors may also be measured to obtain the density of the feed slurry.

b. separated liquid output from centrifuge 10 in the liquid discharge pipe 105. The method set out above may be used in a liquid discharge pipe, using a first and second pressure sensors 104, 106 located along the discharge pipe 105, spaced a few meters apart. The differential pressure readings taken from the pressure sensors 104, 106 sent back to a measurement system 107, such as a computer, which may be a part of the control system PM or separate. The measurement system 107 calculates the pressure differential and density of the slurry can thus be derived. Other factors may also be measured to obtain the density of the feed slurry.

c. the holding tank into which the centrifuge 10 discharges. Preferably the liquid is put into a holding tank 110 of an active mud system of a rig, the measurement advantageously made in the holding tank, preferably using first and second vertically spaced pressure sensors 108, 109 differential pressure is measured in the tank in a similar method to that stated above to calculate density.

The density of the solids output may also be obtained using a solids density sensor or by weighing the tank 122 into which the solids are discharged, sensing a volume and calculating the density therefrom.

2. Feed slurry viscosity may be sampled and measured manually with a Marsh Funnel or by a viscosity sensor and the measured result sent to the control system. The feed slurry viscosity is measured preferably at at least one of the following:

a. input to centrifuge b. liquid output from centrifuge c. the tank that the centrifuge is discharging into 3. Flow rate, i) mass flow rate and/or ii) volume flow rate preferably of the feed slurry flow rate in conduit 42 and advantageously separated liquid flow rate in discharge pipe 105.

i) Mass flow rate is measured using a Coriolis mass flow meter 111, 112. Each Coriolis mass flow meter 111, 112 preferably uses an inlet and an outlet arm which vibrate in synchronous when there is no flow of slurry feed/liquid, but vibrate out of synchronous when there is a flow of slurry feed/liquid. This phase shift in vibration produces a signal indicative of mass flow through the pipe. Each Coriolis meter is in communication with the control system.

ii) Volumetric flow rate is measured with an ultrasonic flow meter or paddle wheel 112, 114, which are in communication with the control system.

4. low gravity drilled solids content of feed slurry % by volume and mass [feed slurry data] measured using a low gravity drilled solids sensor or sampled and analyzed manually at preferably the slurry feed input to centrifuge 10 and/or advantageously the output from centrifuge 10.

5. low gravity commercial solids content of feed slurry % by volume and mass, measured using a low gravity commercial solids sensor or sampled and analyzed manually at preferably the slurry feed input to centrifuge 10 and/or advantageously the output from centrifuge 10

6. high gravity commercial solids content % by volume and mass, measured using a high gravity commercial solids sensor or sampled and analyzed manually at at preferably the slurry feed input to centrifuge 10 and/or advantageously the output from centrifuge 10.

7. % of oil or water on the discharged cuttings by wet or dry calculation measured using a near infrared (NIR) moisture meter 121 at solids output from centrifuge. The solids are discharged through a discharge pipe 120 into a solids collection box 122 or hopper of a solids conveying system. An NIR moisture meter 121 measures the moisture content of the solids and sends a signal representative of the moisture content reading back to the control system PM.

8. Salt content by volume and mass, measured using a salt content sensor or sampled and analyzed manually at preferably the input to centrifuge 10 and advantageously, the liquid output from centrifuge 10.

9. Particle size analysis, measured using a particle size sensor or sampled and analyzed manually at preferably the slurry feed input to centrifuge and advantageously the liquid output from centrifuge 10.

10. Temperature, measured using a thermometer or other temperature sensor preferably at at least one of the following:

a. rotating assembly bearings
b. gearbox
c. VFD control cabinet
d. ambient air
e. motor windings
f. drilling mud input to centrifuge 11. Vibration frequency and amplitude, measured using an accelerometer 64*a*, 64*b*, 64*c*, 64*d* or other suitable device preferably at at least one of the following:

a. rotating assembly bearings 22, 33
b. equipment skid 10*b*
c. gearbox 32

12. Rotational speed of the bowl 12 and conveyor 18 measured using a bowl rotational speed sensor 135 for the bowl 12 a conveyor rotational speed sensor 130 for the conveyor 18.

13. Torque at gearbox input and gearbox output measured using an input torque sensor 140 and output torque sensor.

14. The level of the slurry fluid 11 in the bowl 12, known as pond depth measured preferably using an ultrasonic distance measuring sensor 150. The ultrasonic distance measuring sensor 150 is arranged outside of the bowl 12 aimed at the fluid level in the bowl 12 through the holes 20' in flange 19" of the flanged shaft 19 forming the end plate of the bowl 12. Alternatively or additionally, the position of the adjustable gate 20*a*, 20*a'* is sensed with sensor 155, 155' from which the pond depth can be calculated, as the end of the gate 20*c*, 31. The measurements are sent to the control system PM.

Each of the sensors is preferably controlled by the control system. The control system takes readings from each sensor at predetermined time intervals or continuously. The predetermined time intervals may be at regular time intervals or irregular time intervals. If any of the data is obtained from a manual analysis, the obtained figure may be input to the control system PM. Preferably, the time intervals are such that up-to-date readings can be made from the small change made. The small incremental changes are most preferably made every fifteen minutes and thus readings are preferably taken immediately before the next change is made, for example between ten and fifteen minutes after the change such that the control system can accurately determine if an improvement has been made towards optimum performance to establish in which direction a further change should be made.

Figure 8:
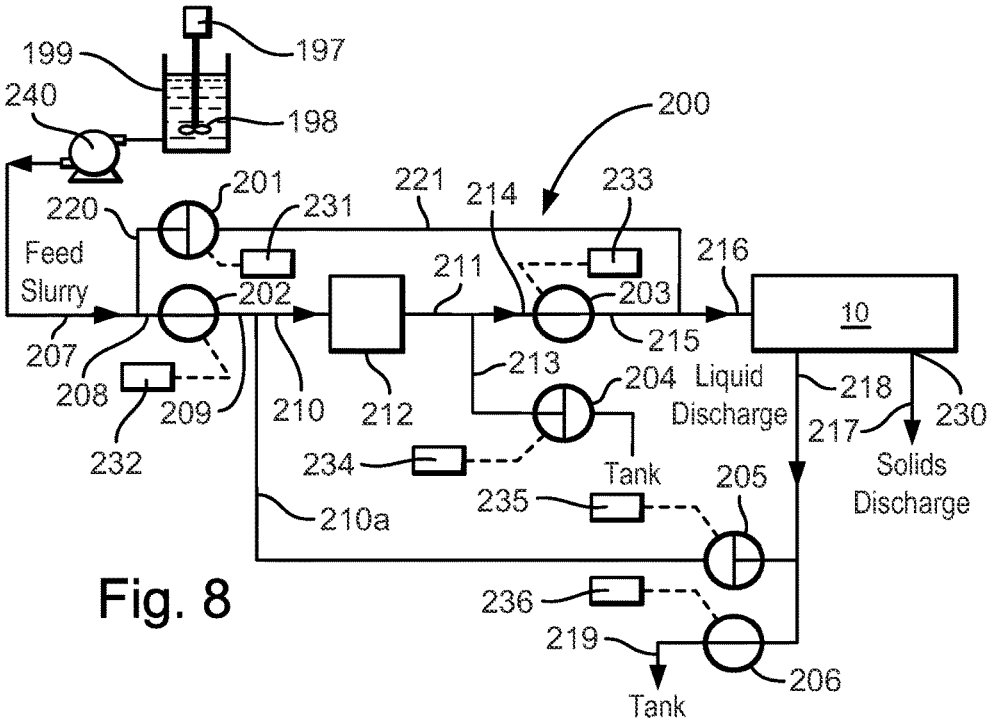
FIG. 8 is a schematic diagram showing a first embodiment of a system in accordance with the present invention shown in a first stage of operation.
Figure 9:
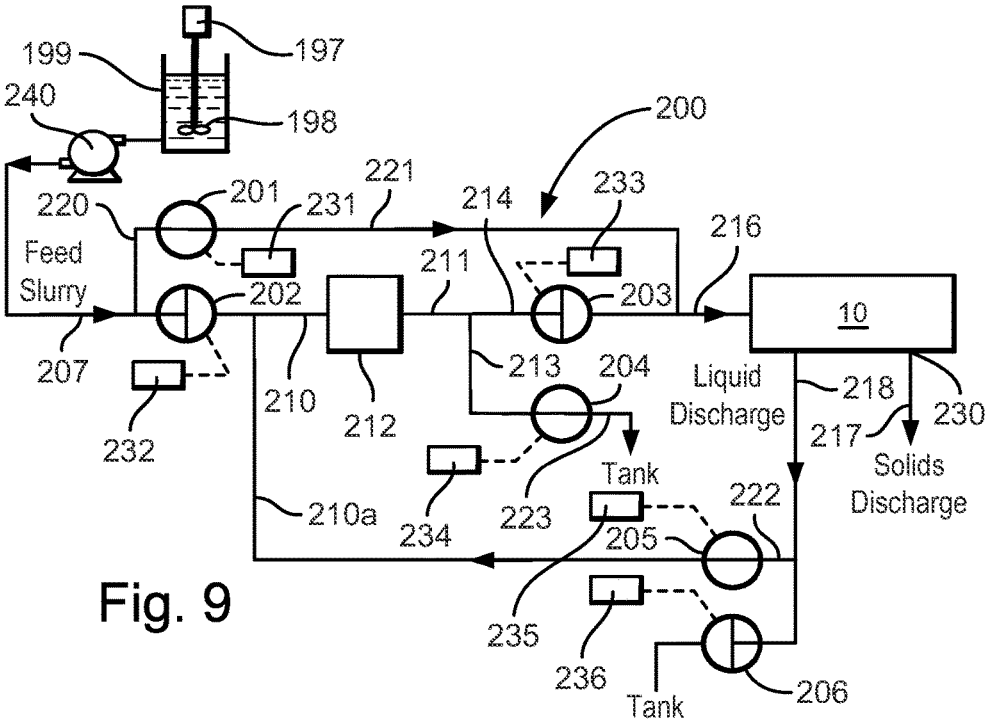
FIG. 9 is a schematic diagram showing the system shown in FIG. 8 in a second stage of operation.

Referring to FIG. 8, there is shown a first embodiment of a flow system in accordance with the present invention in a first stage of operation wherein feed slurry parameters are measured. FIG. 9 shows the feed system shown in FIG. 8 in a second stage of operation wherein liquid discharge parameters are measured.

It will be appreciated that this flow system of FIGS. 8 and 9 may be incorporated into the system shown in FIG. 2, replacing certain parts of that system. The flow system 200 comprises a feed tank 199 and a plurality of two-way flow valves 201 to 206 in a plurality of conduits 207 to 211 and 213 to 223. A parameter measuring apparatus 212, such as a multi-parameter measuring apparatus is arranged in the conduit to measure at least one parameter of the feed slurry.

The feed slurry is drawn from feed tank 199, (like tank 40 of FIG. 2) through conduit 207 using either a feed pump 240 or the head of the feed slurry in the feed tank 199 and flow controlled through a flow control valve (not shown) which can vary the feed rate of the feed slurry. The feed tank 199 usually contains in the order of 50 to 200 barrels (7,900 to 31,800 liters) of solids laden drilling fluid. The feed tank 199 is fed solids laden drilling fluid from at least one further solids laden drilling fluid processor (not shown), such as shale shaker, mud cleaner, hydrocyclone, degasser, settling tank, etc. The at least one further solids laden drilling fluid processor removes certain solids, gases or liquids from the solids laden drilling fluid returned from the well. The feed tank 199 may thus act as a buffer to facilitate containing the solids laden drilling fluid between the centrifuge 10 and the further solids laden drilling fluid processor due to inter alia varying speeds at which the various processors process the solids laden drilling fluid. During drilling, the drill bit (not shown) may pass through different formations strata. The solids laden drilling fluid flowing from the drill bit into the feed tank 199 may thus contain very different solids and have very different properties such as viscosity, and commercially added solid and liquids. Thus, as the drill bit passes from one stratum to another the solids laden drilling fluid may change from a solids laden drilling fluid having a first set of properties to solids laden drilling fluid having a second set of properties. However, this change is not seen as a sudden change by the centrifuge 10, as the solids laden drilling fluid having a second set of properties mixes with the solids laden drilling fluid having a first set of properties in the feed tank 199. Mixing in the feed tank 199 may be induced with an impeller 198 driven by motor 197.

The feed tank 199 may form part of a mud tank system (not shown) comprising a series of tanks. The mud tank system may comprise a first tank fed with underflow of screened solids laden drilling mud from a shale shaker. The first tank may comprise a sand trap, such that sand settles therein on a pan. The sand is tapped off after sufficient build up. The screened solids laden drilling mud is then pumped from the first tank through a degasser to remove at least a portion of any gas which may be present in the screened solids laden drilling mud and flows into a second tank. The screened and degassed solids laden drilling mud is pumped from the second tank through a hydrocyclone to further remove sand particles. The screened, degassed and hydrocycloned solids laden drilling mud flows into a feed tank, such as feed tank 199 for further processing with the centrifuge 10. The first tank may be in the order of 20 to 200 barrels (3200 to 32,000 liters). The second tank may be in the order of 20 to 200 barrels (3200 to 32,000 liters). The feed tank 199 may be in the order of 20 to 200 barrels (3200 to 32,000 liters). The second tank may comprise an impeller to agitate to inhibit solids from settling. The inventors observed that the impellers in the second tank and the feed tank 199 tend to mix incoming flow with the solids laden drilling mud already in the respective second tank and feed tank 199.

The first stage of operation of the flow system is shown in FIG. 8 in which feed slurry parameters are measured. The feed slurry is prevented from flowing from conduit 207 through conduit 220, 221 by closed two-way flow valve 201 and is allowed to flow through open two-way flow valve 202 into conduit 209 and is prevented from flowing through conduit 210*a* by closed two-way flow valve 205 and allowed to flow through line 210 through parameter measuring apparatus 212, such as a multi-parameter measuring apparatus which preferably carries out at least one of the following measurements: mass flow rate; volume flow rate; velocity; viscosity; density; and temperature of the flow of feed slurry across the multi-parameter measuring apparatus. The feed slurry proceeds through conduit 211, prevented from flowing into conduit 213 by a closed two-way flow valve 204 and allowed through conduit 214 through open two-way flow valve 203, into conduit 215 then 216 into centrifuge 10 through a feed tube 16 (see FIG. 1). The feed slurry is prevented from returning through conduit 221 by closed two-way flow valve 201. The centrifuge 10 separates solids from the liquid as disclosed above with regard to FIGS. 1 and 2. The liquid phase is discharged through liquid discharge outlet conduit 218, prevented from flowing through conduit 210*a* by closed two-way flow valve 205 and allowed to flow through open two-way flow valve 206 to a return tank or return line (not shown) of the active mud system for re-circulating in the well. The solids phase is discharged through port 230 into conduit 217.

The second stage of operation of the flow system is shown in FIG. 9 in which liquid discharge parameters are measured. The feed slurry is prevented from flowing from conduit 207 into conduits 210 by closed two-way flow valve 202 and allowed to flow through conduit 220, through open two-way flow valve 201 into conduit 221, through conduit 216 into centrifuge 10 through a feed tube 16 (see FIG. 1). The feed slurry is prevented from returning through conduit 215 by closed two-way flow valve 203. The liquid discharge phase is discharged through liquid discharge outlet conduit 218, prevented from flowing into the return tank and allowed to flow through open two-way flow valve 205 into conduit 210*a* into conduit 210 and through parameter measuring apparatus 212, such as a multi-parameter measuring apparatus which preferably carries out at least one of the following measurements: mass flow rate; volume flow rate; velocity; viscosity; density; and temperature of the flow of liquid discharge phase across the multi-parameter measuring apparatus. The liquid discharge phase continues through conduit 211, prevented from flowing through conduit 214 by closed two-way flow valve 203 and allowed to flow through conduit 213 through open two-way flow valve 204 into the return tank of the active mud system for re-circulating in the well. The solids phase is discharged through port 230 into conduit 217.

Preferably, the parameter measuring apparatus 212 measures mass flow rate using a coriolis meter. The coriolis meter which preferably uses an inlet and an outlet arm or tube which vibrate in synchronous when there is no flow of slurry feed/liquid, but vibrate out of synchronous when there is a flow of slurry feed/liquid. This phase shift in vibration produces a signal indicative of mass flow through the pipe. Preferably, the coriolis meter is arranged such that the flow of solids laden fluid falls vertically therethrough or at such an angle that solids would not settle on the inner pipe wall of the coriolis meter. The parameter measuring apparatus 212 advantageously also measures volume flow rate, preferably with an ultrasonic flow meter or paddle wheel and produces a signal indicative and/or proportional to the volume flow rate. The parameter measuring apparatus 212 advantageously also measures velocity, preferably with an ultrasonic flow meter or paddle wheel and produces a signal indicative and/or proportional to the velocity across the parameter measuring apparatus. The parameter measuring apparatus 212 advantageously also measures the temperature, preferably with a temperature sensor and produces a signal indicative and/or proportional to the temperature in the fluid flowing across the meter. The parameter measuring apparatus 212 advantageously also measures the density, preferably using differential pressure measurement along a part of the feed pipe. First and second pressure sensors (not shown) are located along the conduit 42, preferably at either side of the parameter measuring apparatus 212, thus spaced apart. The differential pressure readings taken from the pressure sensors are sent back as signals to control system PM, which calculates the pressure differential and density of the slurry can thus be derived.

The flow system 200 incorporates a control system PM, such as the control system PM used in the embodiment in FIG. 2. The parameter measuring apparatus 212 is in communication with the control system PM, such that the control system receives signals from the measured parameters therefrom, i.e. at least one and preferably all of: mass flow rate, volume flow rate, velocity, density and temperature. The parameter measuring apparatus 212 is preferably hard wired to the control system PM, advantageously with a data bus link. Alternatively or additionally, the parameter measuring apparatus 212 is wirelessly linked to the control system PM, using a data transfer protocol such as Wi-Fi, blue-tooth or the like. The control system PM also may activate the parameter measuring apparatus 212 when measured parameter readings are required. Each of the two-way flow valve 201 to 206 has a valve position sensor 231 to 236 in communication with the control system PM. The valve position sensors 231 to 236 each send a signal to the control system PM indicative of the position of the valve: open, closed and preferably a signal to indicate if there is a problem with the associated two-way flow valve 201 to 206. Each two-way flow valve 201 to 206 also has an actuator (not shown), such as a stepper motor which is also linked to the control system PM, such that the control system PM controls the actuator to toggle between the two-way flow valve 201 to 206 between an open and closed position. The actuator and valve position sensors 231 to 236 are preferably hard wired to the control system PM, advantageously with a data bus link, preferably using a protocol such as TCP. Alternatively or additionally, the parameter measuring apparatus 212 is wirelessly linked to the control system PM, using a wireless data transfer protocol such as Wi-Fi, blue-tooth or the like.

The control system PM activates the two-way flow valve 201 to 206 to toggle between open and closed positions to alternate flow of feed slurry and liquid discharge phase through the parameter measuring apparatus 212. A short period of time will need to be left before logging data whilst toggling, due to residual liquid and solids in pipe work across the parameter measuring apparatus 212 and in lines 210, 211 and 214. Thus, a short period of flushing time is required to flush through feed slurry when measuring the liquid discharge parameters and of liquid discharge when measuring the feed slurry parameters. For the avoidance of doubt, flushing is carried out by continuing operation of the centrifuge, not a separate flushing step of the pipework only. Furthermore, flow conditions through the centrifuge 10 may be upset slightly at each toggle. Thus, a period of time is allowed before logging parameter measurements with the parameter measuring apparatus 212. The upset period may be longer or shorter than the flushing period, which can both be assessed by continuously taking measurements using the parameter measuring apparatus 212, but only logging the parameter measurements once the control system PM detects the flow when stable. This period may be in the order of one to two minutes. The control system PM preferably toggles every five to sixty minutes and most preferably between ten minutes and thirty minutes.

The conduits 207 to 211 and 213 to 223 may each be a solid walled pipe or a flexible hose or a combination thereof.

Figure 10:
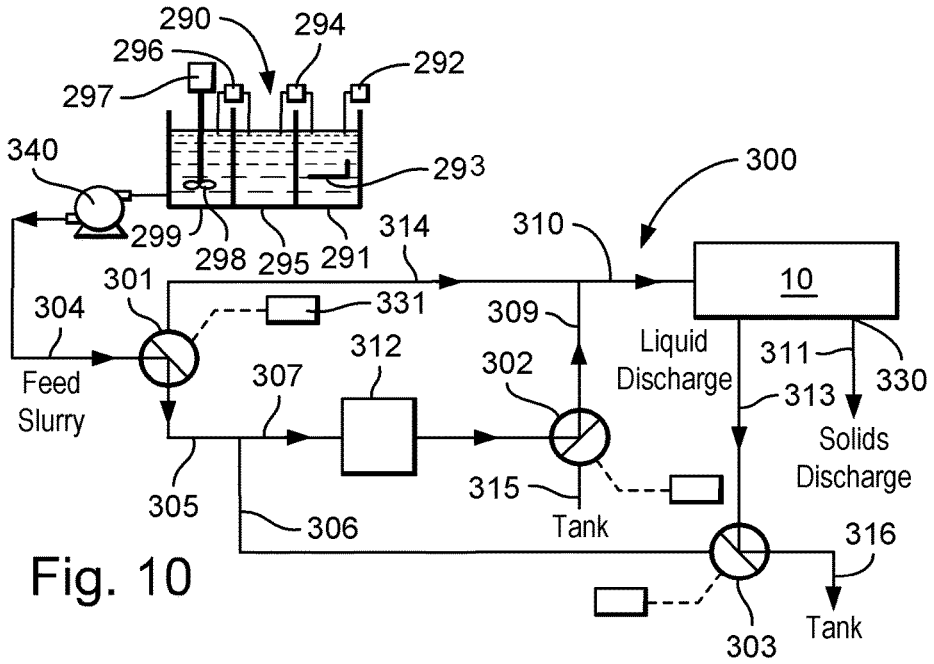
FIG. 10 is a schematic diagram showing a second embodiment of a system in accordance with the present invention shown in a first stage of operation.
Figure 11:
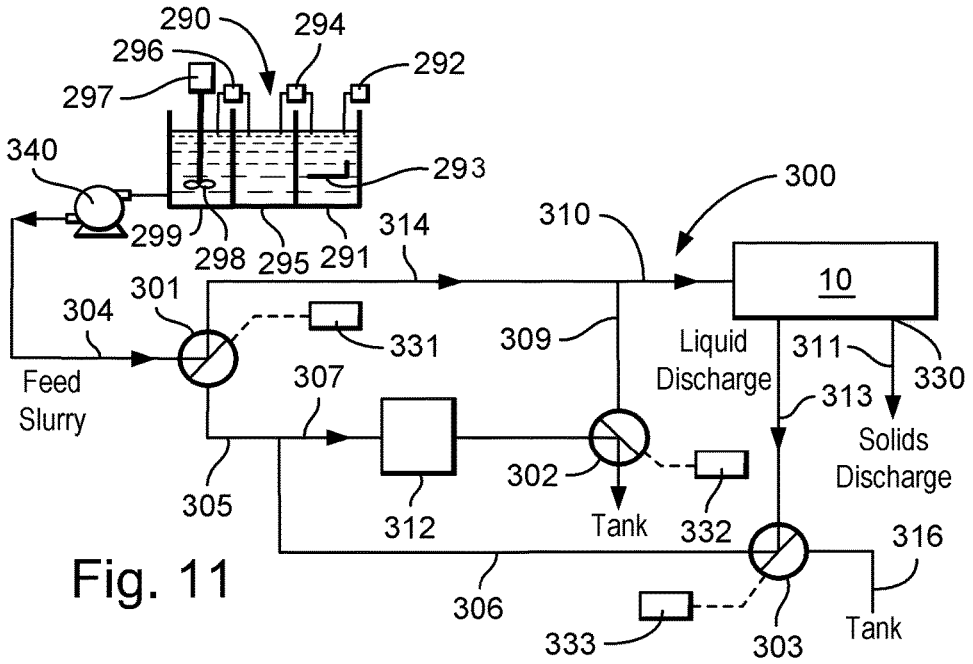
FIG. 11 is a schematic diagram showing the system shown in FIG. 10 in a second stage of operation.

Referring to FIG. 10, there is shown a second embodiment of a flow system in accordance with the present invention in a first stage of operation wherein feed slurry parameters are measured. FIG. 11 shows the feed system shown in FIG. 10 in a second stage of operation wherein liquid discharge parameters are measured.

It will be appreciated that this flow system of FIGS. 10 and 11 may be incorporated into the system shown in FIG. 2, replacing certain parts of that system. The flow system 300 comprises a feed tank 299 and a plurality of three-way flow valves 301 to 303 in a plurality of conduits 304 to 311 and 313 to 316. A parameter measuring apparatus 312, such as a multi-parameter measuring apparatus is arranged in the conduit to measure at least one parameter of the feed slurry.

The feed slurry is drawn from feed tank 299, (like tank 40 of FIG. 2) through conduit 304 using either a feed pump 340 or the head of the feed slurry in the feed tank 299 and flow controlled through a flow control valve (not shown) which can vary the feed rate of the feed slurry. The feed tank 299 usually contains in the order of 50 to 200 barrels (7,900 to 31,800 liters) of solids laden drilling fluid. The feed tank 299 is fed solids laden drilling fluid from at least one further solids laden drilling fluid processor (not shown), such as shale shaker, mud cleaner, hydrocyclone, degasser, settling tank, etc. The at least one further solids laden drilling fluid processor removes certain solids, gases or liquids from the solids laden drilling fluid returned from the well. The feed tank 299 may thus act as a buffer to facilitate containing the solids laden drilling fluid between the centrifuge 10 and the further solids laden drilling fluid processor due to inter alia varying speeds at which the various processors process the solids laden drilling fluid. During drilling, the drill bit (not shown) may pass through different formations strata. The solids laden drilling fluid flowing from the drill bit into the feed tank 299 may thus contain very different solids and have very different properties such as viscosity, and commercially added solid and liquids. Thus, as the drill bit passes from one stratum to another the solids laden drilling fluid may change from a solids laden drilling fluid having a first set of properties to solids laden drilling fluid having a second set of properties. However, this change is not seen as a sudden change by the centrifuge 10, as the solids laden drilling fluid having a second set of properties mixes with the solids laden drilling fluid having a first set of properties in the feed tank 299. Mixing in the feed tank 299 may be induced with an impeller 298 driven by motor 297.

The feed tank 299 may form part of a mud tank system 290 comprising a series of tanks. The mud tank system may comprise a first tank 291 fed with underflow of screened solids laden drilling mud from a shale shaker 292. The first tank 291 may comprise a sand trap 293, such that sand settles therein on a pan. The sand is tapped off after sufficient build up. The screened solids laden drilling mud is then pumped from the first tank 291 through a degasser 294 to remove at least a portion of any gas which may be present in the screened solids laden drilling mud and flows into a second tank 295. The screened and degassed solids laden drilling mud is pumped from the second tank 295 through a hydrocyclone 296 to further remove sand particles. The screened, degassed and hydrocycloned solids laden drilling mud flows into the feed tank 299 for further processing with the centrifuge 10. The first tank 291 may be in the order of 20 to 200 barrels (3200 to 32,000 liters). The second tank 295 may be in the order of 20 to 200 barrels (3200 to 32,000 liters). The feed tank 299 may be in the order of 20 to 200 barrels (3200 to 32,000 liters). The second tank 295 may comprise an impeller to agitate to inhibit solids from settling. The inventors observed that the impeller 298 in the feed tank 299 tend to mix incoming flow with the solids laden drilling mud already in the respective second tank 295 and feed tank 299.

The first stage of operation of the flow system is shown in FIG. 10 in which feed slurry parameters are measured. The feed slurry is prevented from flowing from conduit 304 through conduit 314 by orientation of three-way flow valve 301 and is allowed to flow through conduits 305 and 307 and is prevented from flowing through conduit 306 by orientation of three-way flow valve 302. The feed slurry flows from conduit 307 through parameter measuring apparatus 312, such as a multi-parameter measuring apparatus which preferably carries out at least one of the following measurements: mass flow rate; volume flow rate; velocity; viscosity; density; and temperature of the flow of feed slurry across the multi-parameter measuring apparatus. The feed slurry proceeds through three-way flow valve 302 into conduit 309 and is prevented from flowing into return tank by orientation of the three-way flow valve. The feed slurry flows from conduit 309 into conduit 310 and is prevented from returning in conduit 314 by the orientation of three-way flow valve 301. The feed slurry flows from conduit 310 into centrifuge 10 through a feed tube 16 (see FIG. 1). The centrifuge 10 separates solids from the liquid as disclosed above with regard to FIGS. 1 and 2. The liquid phase is discharged through liquid discharge outlet conduit 313, prevented from flowing through conduit 306 by orientation of three-way flow valve 303 and allowed to flow through three-way flow valve 303 to the return tank or return line (not shown) of the active mud system for re-circulating in the well. The solids phase is discharged through port 330 into conduit 311.

The second stage of operation of the flow system is shown in FIG. 11 in which liquid discharge parameters are measured. The feed slurry is prevented from flowing from conduit 305 by orientation of three-way flow valve 301 and allowed to flow through conduits 314 into conduit 310 and into centrifuge 10 through a feed tube 16 (see FIG. 1). The feed slurry is prevented from returning through conduit 309 by orientation of three-way flow valve 302. The liquid discharge phase is discharged through liquid discharge outlet conduit 313, prevented from flowing into the return tank and allowed to flow through three-way flow valve 303 into conduit 306 into conduit 307 and through parameter measuring apparatus 312, such as a multi-parameter measuring apparatus which preferably carries out at least one of the following measurements: mass flow rate; volume flow rate; velocity; viscosity; density; and temperature of the flow of liquid discharge phase across the multi-parameter measuring apparatus. The liquid discharge phase continues through conduit 317, prevented from flowing through conduit 309 by orientation of three-way flow valve 302 and allowed to flow into the return tank of the active mud system for recirculating in the well. The solids phase is discharged through port 330 into conduit 311.

Preferably, the parameter measuring apparatus 312 measures mass flow rate using a coriolis meter. The coriolis meter which preferably uses an inlet and an outlet arm or tube which vibrate in synchronous when there is no flow of slurry feed/liquid, but vibrate out of synchronous when there is a flow of slurry feed/liquid. This phase shift in vibration produces a signal indicative of mass flow through the pipe. Preferably, the coriolis meter is arranged such that the flow of solids laden fluid falls vertically therethrough or at such an angle that solids would not settle on the inner pipe wall of the coriolis meter. The parameter measuring apparatus 312 advantageously also measures volume flow rate, preferably with an ultrasonic flow meter or paddle wheel and produces a signal indicative and/or proportional to the volume flow rate. The parameter measuring apparatus 312 advantageously also measures velocity, preferably with an ultrasonic flow meter or paddle wheel and produces a signal indicative and/or proportional to the velocity across the parameter measuring apparatus. The parameter measuring apparatus 312 advantageously also measures the temperature, preferably with a temperature sensor and produces a signal indicative and/or proportional to the temperature in the fluid flowing across the meter. The parameter measuring apparatus 312 advantageously also measures the density, preferably using differential pressure measurement along a part of the feed pipe. First and second pressure sensors (not shown) are located along the conduit 42, preferably at either side of the parameter measuring apparatus 312, thus spaced apart. The differential pressure readings taken from the pressure sensors are sent back as signals to control system PM, which calculates the pressure differential and density of the slurry can thus be derived.

The flow system 300 incorporates a control system PM, such as the control system PM used in the embodiment in FIG. 2. The parameter measuring apparatus 312 is in communication with the control system PM, such that the control system receives signals from the measured parameters therefrom, i.e. at least one and preferably all of: mass flow rate, volume flow rate, velocity, density and temperature. The parameter measuring apparatus 312 is preferably hard wired to the control system PM, advantageously with a data bus link. Alternatively or additionally, the parameter measuring apparatus 312 is wirelessly linked to the control system PM, using a data transfer protocol such as Wi-Fi, blue-tooth or the like. The control system PM also may activate the parameter measuring apparatus 312 when measured parameter readings are required. Each of the three-way flow valves 301 to 303 has a valve position sensor 331 to 333 in communication with the control system PM. The valve position sensors 331 to 333 each send a signal to the control system PM indicative of the position of the valve: open, closed and preferably a signal to indicate if there is a problem with the associated two-way flow valve 301 to 303. Each three-way flow valve 301 to 303 also has an actuator (not shown), such as a stepper motor which is also linked to the control system PM, such that the control system PM controls the actuator to toggle between the two-way flow valve 301 to 303 between an open and closed position. The actuator and valve position sensors 331 to 333 are preferably hard wired to the control system PM, advantageously with a data bus link, preferably using a protocol such as TCP. Alternatively or additionally, the parameter measuring apparatus 312 is wirelessly linked to the control system PM, using a wireless data transfer protocol such as Wi-Fi, blue-tooth or the like.

The control system PM activates the two-way flow valve 201 to 206 to toggle between open and closed positions to alternate flow of feed slurry and liquid discharge phase through the parameter measuring apparatus 312. A short period of time will need to be left before logging data whilst toggling, due to residual liquid and solids in pipe work across the parameter measuring apparatus 312 and in lines 306, 307 and 317. Thus, a short period of flushing time is required to flush through feed slurry when measuring the liquid discharge parameters and of liquid discharge when measuring the feed slurry parameters. For the avoidance of doubt, flushing is carried out by continuing operation of the centrifuge, not a separate flushing step of the pipework only. Furthermore, flow conditions through the centrifuge 10 may be upset slightly at each toggle. Thus, a period of time is allowed before logging parameter measurements with the parameter measuring apparatus 312. The upset period may be longer or shorter than the flushing period, which can both be assessed by continuously taking measurements using the parameter measuring apparatus 312, but only logging the parameter measurements once the control system PM detects the flow when stable. This period may be in the order of one to two minutes. The control system PM preferably toggles every five to sixty minutes and most preferably between ten minutes and thirty minutes.

The conduits 304 to 311 and 313 to 317 may each be a solid walled pipe or a flexible hose or a combination thereof.

The discharged liquid phase may flow from the conduit 217,311 into a further centrifuge (not shown) to be further processed, particularly, but not exclusively to remove barites from drilling mud. The centrifuges may run at different speeds, such as a slow speed for the first centrifuge and a high speed for the second centrifuge. Each of the two centrifuges may use a flow system of the present invention.

What is claimed is:

1. A system for separating solids from a solids laden drilling fluid, the system comprising a centrifuge and a flow apparatus:

the centrifuge comprising an inlet, a liquid phase outlet, a solids discharge outlet, and a radially slideable gate coupled to a retractable arm that is coupled to a linear motor, wherein the radially slideable gate is configured to control a level of slurry fluid within the centrifuge;

wherein the flow apparatus comprises:

a feed conduit carrying the solids laden drilling fluid to the inlet of the centrifuge;

a liquid discharge conduit carrying a discharged liquid phase from the liquid phase outlet of the centrifuge;

a parameter measuring apparatus connected to the feed conduit and the liquid discharge conduit and configured to measure solids laden drilling fluid parameters during a first stage of operation and discharged liquid phase parameters during a second stage of operation while the solids laden drilling fluid is fed into the separation apparatus; and a plurality of valves selectively configurable to allow the solids laden drilling fluid through the parameter measuring apparatus to the feed conduit carrying the solids laden drilling fluid to the inlet of the centrifuge during the first stage of operation and allow the discharged liquid phase from the liquid phase outlet through the parameter measuring apparatus to a return line to return the discharged in liquid phase to a return tank during the second stage of operation.

2. The system of claim 1, wherein at least one valve comprises a two-way valve.

3. The system of claim 1, wherein at least one valve comprises a three-way valve.

4. The system of claim 1, further comprising: a feed tank connected to the feed conduit.

5. The system of claim 4, wherein the feed tank forms part of a tank system.

6. The system of claim 1, wherein the parameter measuring apparatus comprises a coriolis meter for measuring mass flow.

7. The system of claim 1, wherein the parameter measuring apparatus comprises a temperature sensor to measure temperature.

8. The system of claim 1, wherein the parameter measuring apparatus comprises a plurality of pressure sensors for use in measuring a pressure differential and calculating density therefrom.

9. The system of claim 1, wherein the parameter measuring apparatus comprises a velocity sensor.

10. The system of claim 1, further comprising: a control system configured to receive data from said parameter measuring apparatus.

11. A method of operating a centrifuge, the method comprising:

flowing a solids laden drilling fluid through a feed conduit into the centrifuge comprising an inlet, a liquid phase outlet, a solids discharge outlet, and a radially slideable gate coupled to a retractable arm that is coupled to a linear motor;

conveying discharged liquid phase from the liquid phase outlet through a liquid discharge conduit;

controlling a level of slurry fluid, within the centrifuge, with the radially slideable gate;

discharging a solids phase from the solids discharge outlet through a solids discharge outlet;

connecting a parameter measuring apparatus to the feed conduit and the liquid discharge conduit, such that the parameter measuring apparatus is configured to measure solids laden drilling fluid parameters in the feed conduit during a first stage of operation and discharged liquid phase parameters in the liquid discharge conduit during a second stage of operation while the solids laden drilling fluid is processed by the centrifuge; and selectively configuring a plurality of valves to allow solids laden drilling fluid through the parameter measuring apparatus during the first stage of operation and allow a discharged liquid phase through the parameter measuring apparatus during the second stage of operation.

12. The method of claim 11, further comprising: logging the at least one parameter of the solids laden drilling fluid and the discharged liquid phase with a logging apparatus.

13. The method of claim 12, wherein the logging comprises logging the parameter of the solids laden drilling fluid once every two to sixty minutes with the logging apparatus.

14. The method of claim 12, wherein the logging comprises logging the parameter of the liquid discharge phase once every ten to sixty minutes with the logging apparatus.

15. The method of claim 11, further comprising: activating at least one valve to selectively allow one of the solids laden drilling fluid and the liquid discharge phase to pass through the parameter measuring apparatus.

16. The system of claim 1, wherein the solids discharge outlet comprises a discharge port.

* * * * *